US005952924A

United States Patent [19]

Evans et al.

[11] Patent Number: 5,952,924

[45] **Date of Patent: *Sep. 14, 1999**

[54] METHOD AND APPARATUS FOR ENFORCING HYGIENE

[75] Inventors: Bennie R. Evans, 101 W. Lake Dr., Medicine Park, Okla. 73557; Larry R. Tucker, Euless, Tex.; Walter D. Ballew, Midwest City, Okla.; Anthony Layton, Lawton, Okla.; James E. Britton, Durant, Okla.

[73] Assignee: Bennie R. Evans, Medicine Park, Okla.

[ * ] Notice: This patent is subject to a terminal disclaimer.

[21] Appl. No.: 08/984,755

[22] Filed: Dec. 4, 1997

[51] Int. Cl.[6] ..... G08B 23/00

[52] U.S. Cl. ..... 340/573.1; 340/528; 340/600; 340/632; 340/691.4; 340/693.5

[58] Field of Search ..... 340/573.1, 632, 340/540, 541, 825.31, 825.32, 555, 556, 528, 309.15, 691.4, 691.5, 692, 600; 73/23.2, 23.34, 19.1; 40/1.6, 463

[56] References Cited

U.S. PATENT DOCUMENTS

| | | | |
|---|---|---|---|
| 3,725,895 | 4/1973 | Haynes | 340/572 |
| 3,967,478 | 7/1976 | Guinn | 70/144 |
| 4,045,997 | 9/1977 | Showalter et al. | 73/23.2 |
| 4,297,689 | 10/1981 | Shaw et al. | 340/632 |
| 4,598,275 | 7/1986 | Ross et al. | 340/573 |
| 4,603,326 | 7/1986 | Freed | 340/572 |
| 4,655,235 | 4/1987 | Scott, Jr. | 134/99.1 |
| 4,665,385 | 5/1987 | Henderson | 340/539 |
| 4,682,155 | 7/1987 | Shirley | 340/573 |
| 4,684,933 | 8/1987 | Dill | 340/572 |
| 4,896,144 | 1/1990 | Bogstad | 340/691 |
| 4,964,309 | 10/1990 | Jenkins | 73/864.81 |
| 5,023,597 | 6/1991 | Salisbury | 340/572 |
| 5,202,666 | 4/1993 | Knippscheer | 340/573 |
| 5,610,589 | 3/1997 | Evans et al. | 340/573 |
| 5,808,553 | 9/1998 | Cunningham | 340/573 |
| 5,812,059 | 9/1998 | Shaw et al. | 340/573 |

FOREIGN PATENT DOCUMENTS

| | | | |
|---|---|---|---|
| 300886 | 12/1990 | Japan | 340/540 |
| 1333060 | 10/1973 | United Kingdom . | |
| 2265038 | 9/1993 | United Kingdom | 340/825.32 |
| 05965 | 5/1990 | WIPO | 340/825.31 |
| 133277 | 8/1992 | WIPO . | |
| 28525 | 12/1994 | WIPO | 340/632 |

*Primary Examiner*—Thomas Mullen
*Attorney, Agent, or Firm*—Dunlap, Codding & Rogers

[57] ABSTRACT

The present invention is a system for encouraging workers who work in a hygienically controlled area to wash their hands before exiting an associated sanitation area. Broadly, the present invention comprises a housing located in the sanitation area for receiving at least a portion of the hands of the worker. A detector is operatively associated with the housing. The detector detects whether or not the hands of the worker have recently been washed in response to the insertion of the hands of the worker into the housing. A communication media is also operatively associated with the detector for outputting one of a sanitary signaling media in response to the detection that the hands of the worker have been washed and an unsanitary signaling media in response to the detection that the hands of the worker have not been washed.

18 Claims, 3 Drawing Sheets

METHOD AND APPARATUS FOR ENFORCING HYGIENE

STATEMENT REGARDING FEDERALLY SPONSORED RESEARCH OR DEVELOPMENT

Not applicable.

CROSS REFERENCE TO RELATED APPLICATIONS

Not applicable.

BACKGROUND OF THE INVENTION

1. Field of the Invention

This invention relates to improvements in methods and apparatus for enforcing hygiene.

2. Background

Unclean practice has been well known for many years. Bacteria and other microbial organisms which are the cause of many contagious diseases are capable of being transmitted from infected individuals to many other people if sanitary conditions are not maintained in such settings where the microbial organisms and where people are susceptible to receiving into their bodies such microbial microorganisms.

At the present time, many diseases, such as hepatitis A have been found to be transmittable due to a failure of people to wash their hands with soap and water thoroughly after using a public toilet. In fact, some public health laws require those in the food distribution field to wash their hands each time they enter the rest room facilities before they resume their duties.

Conventionally, the requirement for employees to wash their hands is attempted by the posting of signs and/or intermittent checks by supervisory personnel.

Some effort to produce a system for enforcing hygienic practices in such facilities as restaurants and hospitals have been proposed. However, known prior systems have relied on such tools as audible signals to workers who exist a toilet facility without having done such things as turn on a water faucet or operate a hand drying apparatus. Such systems do not analyze the worker's hands to assure that the worker has washed his or her hands.

SUMMARY OF THE INVENTION

The present invention is a system for encouraging workers who work in a hygienically controlled area to wash their hands before exiting an associated sanitation area. Broadly, the present invention comprises a means located in the sanitation area for receiving at least a portion of the hands of the worker.

A detector means is operatively associated with the means for receiving at least the portion of the worker's hands. The detector means detects whether or not the hands of the worker have recently been washed in response to the insertion of the hands of the worker into the means for receiving.

Means are also operatively associated with the detector means for outputting one of a sanitary signaling media in response to the detection that the hands of the worker have been washed and an unsanitary signaling media in response to the detection that the hands of the worker have not been washed.

In some embodiments of the present invention, the detector means detects a detectable substance on the hands of the worker to determine whether or not the hands of the worker have been washed.

The means for outputting the sanitary signaling media in response to the detection that the hands of the worker have been washed is preferably accomplished by the transmitting of a signal to a badge element to enable a sanitary signaling media located thereon.

The system preferably automatically enables or outputs an unsanitary signaling media when the worker enters the sanitation area to indicate that the worker needs to wash his or her hands before exiting the sanitation area. The means for outputting the unsanitary signaling media in response to the detection that the hands of the worker have not been washed is preferably accomplished by not disabling the unsanitary signaling media which was previously enabled.

Thus, workers will have difficulty circumventing the required hygienic procedures, as, for example, by merely turning on a water faucet and pressing a soap dispenser without actually washing their hands. This should decrease the spread of communicable diseases and increase the compliance with public health laws. Other objects, features and advantages of the present invention will be apparent from the following detailed description when read in conjunction with the accompanying drawings and appended claims.

DETAILED DESCRIPTION OF THE INVENTION

1. System Overview

Figure 1:
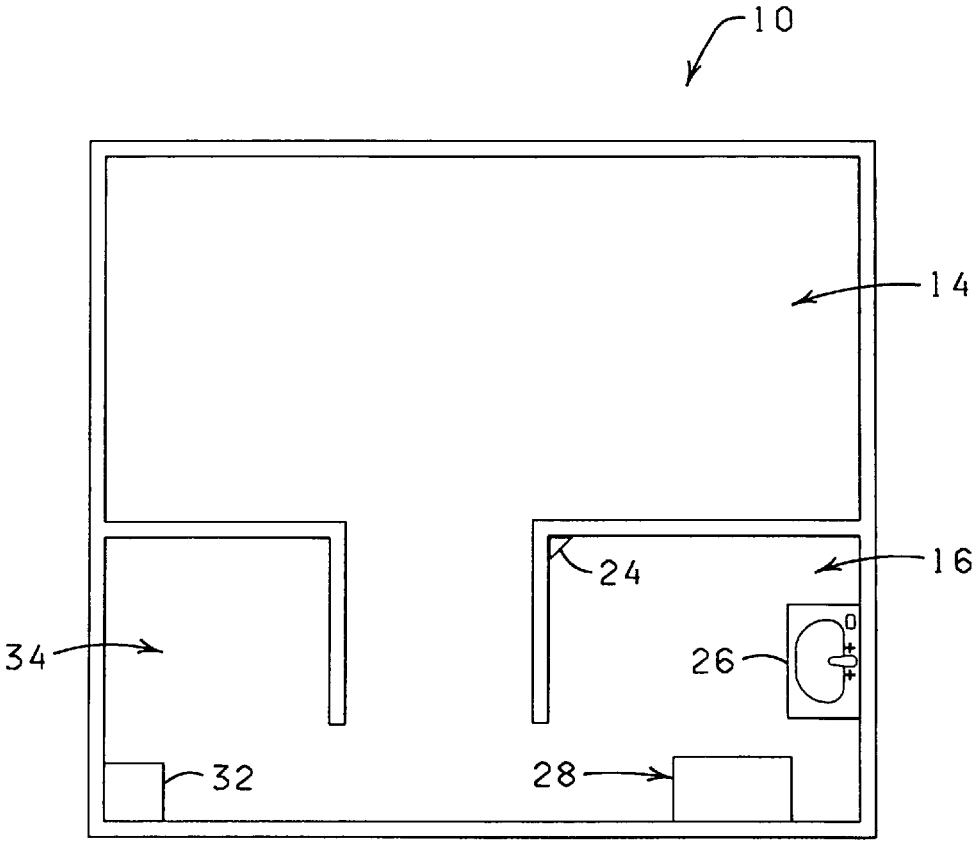
FIG. 1 is a typical layout of a hygienically controlled area with an associated sanitation area.

Referring now to the drawings and more particularly to FIG. 1, shown therein is a system 10 for encouraging workers 12 (FIG. 4) who work in a hygienically controlled area 14 to wash their hands with soap and water before exiting an associated sanitation area 16. The hygienically controlled area 14 can be a restaurant, hospital or other area where it is desirable that people maintain proper hygiene, for example. The sanitation area 16 can be wash rooms or rest rooms, for example.

Figure 2:
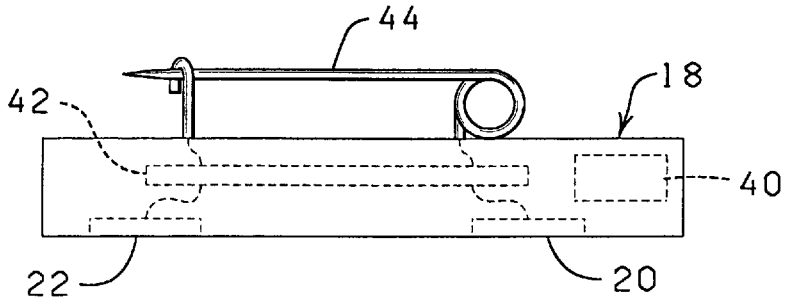
FIG. 2 is a top plan view of a badge element.

Each of the workers 12 is provided with a badge element 18 (FIG. 2) attached to the worker 12, such as by clipping the badge element 18 to the worker's clothing. The badge element 18 includes a communication media 20 and a receiver 22 (FIG. 2). As will be discussed below with reference to FIG. 3, the communication media 20 can be in the form of: visual indicia such as colored lights, text and/or graphics; or auditory indicia such as beeps, and/or digital voice messages.

The communication media 20 desirably communicates at least three types of information: a sanitary signaling media; an unsanitary signaling media; and a tamper signaling media. The unsanitary signaling media indicates that the particular worker 12 needs to wash their hands with soap and water. The sanitary signaling media indicates that the worker 12 is likely to have recently washed his or her hands thoroughly with soap and water. The tamper signaling media indicates that the particular worker 12 wearing the badge element 18 has likely attempted to "fool" the system 10 into indicating that the worker 12 has successfully washed his or her hands with soap and water, when in fact the worker 12 has not.

The system 10 is further provided with a first transmitter 24, a soap and water dispenser 26, and a hygiene enforcing apparatus 28 located in the sanitation area 16. The first transmitter 24 can be an infrared transmitter located on the ceiling of the sanitation area 16. When the worker 12 enters the sanitation area 16, the first transmitter 24 transmits a signal to the receiver 22 of the badge element 18 to enable the unsanitary signaling media on the communication media 20 to indicate that the worker 12 needs to wash his or her hands.

The soap and water dispenser 26 is provided with a special soap mixture which contains a dilute concentration of a detectable substance, such as alcohol. A residue of the detectable substance in the special soap mixture remains on the hands of the worker 12 for a period of about 1.5 minutes subsequent to the washing and drying of the hands of the worker 12. When the worker 12 disposes his or her hands adjacent the hygiene enforcing apparatus 28, the concentration of the detectable substance on the hands (FIG. 4) of the worker 12 is detected. Although in a preferred embodiment, the detecting of the detectable substance is performed when the hands of the worker 12 are dry, it should be understood that such detection can also be performed when the hands of the worker 12 are wet (before or during the drying of the hands).

If the concentration of the detectable substance is within a preselected range, the hygiene enforcing apparatus 28 enables a second transmitter 30 (FIGS. 4 and 5) to transmit a signal to the receiver 24 of the badge element 18 to enable the sanitary signaling media thereon and disable the unsanitary signaling media. This indicates that the worker 12 has successfully washed his or her hands.

If the concentration of the detectable substance is below the preselected range, the hygiene enforcing apparatus 28 does not transmit a signal to the badge element 18. Thus, the unsanitary signaling media on the communication media 21 remains in an enabled condition to communicate that the worker 12 still needs to wash his or her hands.

If the concentration of the detectable substance is above the preselected range, the hygiene enforcing apparatus 28 enables the second transmitter 30 to transmit a signal to the receiver 22 of the badge element 18 to enable the tamper signaling media, disable the unsanitary signaling media and disable the receiver 22 for an indefinite period of time. This indicates that the worker 12 has probably attempted to fool the system by merely disposing soap on his or her hands and then placing such hands near the hygiene enforcing apparatus 28. The receiver 22 of the badge element 18 is disabled indefinitely so that the tamper signaling media will not be disabled by any signals transmitted by the first transmitter 24. To clear the tamper signaling media on the badge element 18, the badge element 18 must be disposed in a tamper clearing device 32 (FIG. 1). A key (not shown) should be turned once the badge element 18 is disposed in the tamper clearing device 32 to disable the tamper signaling media and enable the unsanitary signaling media. It is envisioned that the tamper clearing device 32 be located in a supervisor's office 34 and under the control of the particular worker's supervisor so that the worker's supervisor will be aware of the attempt by the worker 12 to circumvent the system 10.

2. Operation of Badge Element 18

Figure 3:
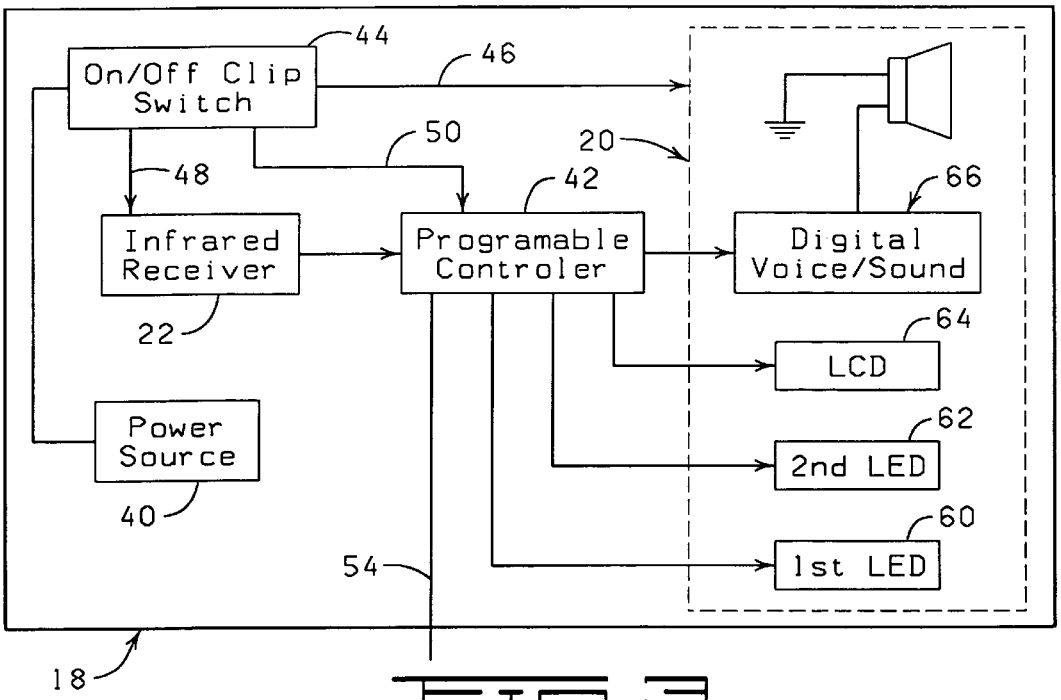
FIG. 3 is a block diagram of the electrical/electronic components contained in the badge element worn by each worker to be monitored.

The badge element 18 and associated high level block diagram are shown in FIGS. 2 and 3. The actual badge element 18 may be, for example, a name tag having a size of about 3" wide×1¼" high×½" deep.

The badge element 18 is powered by a power source 40. The power source 40 can be 4 1.25 volt nickel cadmium batteries to provide 5 volts. These batteries can be recharged as necessary by either solar cells or from a more conventional source, 115 V.A.C. All circuitry, where possible, is (Complimentary Metal Oxide Semiconductor) (CMOS) to minimize the power consumption and prolong battery life.

The receiver 22 of the badge element 18 is capable of receiving signals from the first transmitter 24 (which can be located in the sanitation area 16) and the second transmitter 30 of the hygiene enforcing apparatus 28. The signals received by the receiver 22 are transmitted to a programmable micro-controller 42. The programmable micro-controller 42 can be an embedded micro-controller, such as a PIC16F84 manufactured by micro chip.

The first transmitter 24 and the second transmitter 30 can be infrared transmitters utilizing an infrared diode, for example. The receiver 22 can be a photodiode capable of receiving the infrared signals, such as a BP104 obtainable from Siemens.

The badge element 18 is provided with an on/off clip switch 44 disposed on the rear of the badge element 18. The on/off clip switch 44 activates the communication media 20, the infrared receiver 22, and the programmable micro controller 42 via communication links 46, 48 and 50 when the badge element 18 is pinned onto the clothes of the worker 12. Upon powering on the badge element 18 by pinning the on/off clip switch 44 to the clothing of the worker 12, the programmable micro-controller 42 is programmed to enable the unsanitary signaling media of the communication media 20. This insures that the worker 12 begins the work period by practicing sanitary health habits. This also insures that the worker 12 cannot avert the system 10 by unpinning the badge element 18 and disposing same into their pocket when entering the sanitation area 16 to prevent the reception of the signal transmitted by the first transmitter 24.

In response to the badge element 18 being activated, the programmable micro-controller 42 receives the signals output by the receiver 22. In response thereto, the programmable micro-controller 42 outputs signals to the communication media 20. The signals output to the communication media 20 are indicative of the signals received by the programmable micro-controller 42. There are four types of signals which are transmitted to the programmable micro-controller 42 by the receiver 22. These four signals will be discussed hereinafter.

The first signal is provided to the receiver 22 and thus the programmable micro-controller 42 by the first transmitter 24 upon entry into the sanitation area 16 by the worker 12. In response to receiving the first signal, the programmable micro-controller 42 disables the sanitary signaling media of the communication media 20 (if the sanitary signaling media had been previously enabled) and enables the unsanitary signaling media 20 of the communication media to indicate that the worker 12 needs to wash his or her hands.

The second signal is provided to the receiver 22 and thus the programmable micro-controller 42 by the second transmitter 30 in response to the hygiene enforcing apparatus 28 detecting a concentration of the detectable substance within a predetermined range. In response to receiving the second signal, the programmable micro-controller 42 outputs a signal to the communication media 20 to disable the unsanitary signaling media and to enable the sanitary signaling media to indicate that the worker 12 has satisfactorily washed his or her hands. The programmable micro-controller 42 is programmed to disable the receiver 22 for the passage of a predetermined period of time of approximately 15 seconds subsequent to the reception of the second signal. This permits the worker 12 to exit the sanitation area 16 without allowing the receiver 22 to inadvertently detect a newly received transmitted signal from the first transmitter 24. If the worker 12 remains in the sanitation area 16 for a passage of time longer than the predetermined period, then the worker 12 will have to rewash their hands.

The third signal is provided to the programmable micro-controller 42 by the second transmitter 30 in response to the hygiene enforcing apparatus 28 detecting a concentration of the detectable substance above the preselected range. In response thereto, the programmable micro-controller 42 outputs a signal to the communication media 20 to enable the tamper signaling media and to disable the unsanitary signaling media to indicate that the worker 12 has likely attempted to avert the system 10. The programmable micro-controller 42 also disables the receiver 22 for an indefinite period of time to avoid the badge element 18 being reset by the first transmitter 24. Once the badge element 18 enters the tamper mode, the badge element 18 must be disposed in the tamper clearing device 32 to disable the tamper signaling media. The tamper clearing device 32 provides a signal to the programmable micro-controller 42 via the communication link 54 to disable the tamper signaling media and enable the unsanitary signaling media, as previously discussed with reference to FIG. 1.

The fourth signal is generated when the receiver 22 is placed into a very dark location for the passage of a predetermined period of time greater than about 30 seconds, for example. Upon receipt of the fourth signal, the programmable micro-controller is programmed to output a signal to the communication media 20 to enable the tamper signaling media and to disable the receiver 22 for an indefinite period of time. This insures that the worker cannot avert the system 10 by covering the badge element 18 with their hands, for example, when entering the sanitation area 16 to prevent the receiver 22 of the badge element 18 from receiving the first signal, discussed above.

The programmable micro-controller 42 can also be programmed to automatically "time-out" by enabling the unsanitary signaling media and disabling the sanitary signaling media after the passage of a predetermined period of time of about 30 minutes, for example, subsequent to the enabling of the sanitary signaling media. This insures that workers 12 must wash their hands with soap and water on a periodic basis throughout the workday.

As shown in FIG. 3, the communication media 20 can be in the form of a visual indicia such as a first light 60 and a second light 62. In one embodiment, the first light 60 can be green and the second light 62 can be red.

The first light 60 and the second light 62 can be operated as follows to convey the appropriate information. For example, the unsanitary signaling media can be indicated by the flashing of the red second light 62 at a slow rate. The sanitary signaling media can be indicated by the flashing of the green first light 60 at a slow rate. The tamper signaling media can be represented by the intermittent flashing of both the green first light 60 and the red second light 62. Finally, the communication media 20 can be adapted to change the flashing of the green first light 60 to a faster rate in response to the badge element 18 being within a predetermined period of time of about 5 minutes, for example, of time-out, as previously described with reference to FIGS. 2 and 3. This gives the worker 12 an indication to wash his or her hands before the badge element 18 times out to avoid unnecessary embarrassment.

The communication media 20 can also give a visual indication of the mode of the badge element 18 via a visual display 64, such as a liquid crystal display. The visual display 64 can be provided to give a text and/or graphical message to indicate the current mode of the badge element 18.

The communication media 20 can also provide an auditory indicia of the mode of the badge element 18 via a speaker system 66. The speaker system 66 can provide either a tone (beep) code, i.e. one short beep every predetermined period to indicate a sanitary signaling media, two short beeps every predetermined period to indicate an unsanitary signaling media, and three short beeps every predetermined period to indicate a tamper signaling media. Both the beep duration and the predetermined period between beeps can be adjusted by programming the programmable micro-controller 42. The speaker system 66 can also generate a user selected digital voice message to indicate badge status. The user selected digital voice message can be generated by an ISD2560 obtainable from Intelligent System Devices, Inc.

It should be noted that communication media 20 can be provided with the first and second lights 60 and 62, the display 64, and the speaker system 66 separately or in combination. For example, the first and second lights 60 and 62 can be used in combination with the speaker system 66 to give both a visual and audio indication of the current badge status.

3. The Hygiene Enforcing Apparatus.

Figure 4:
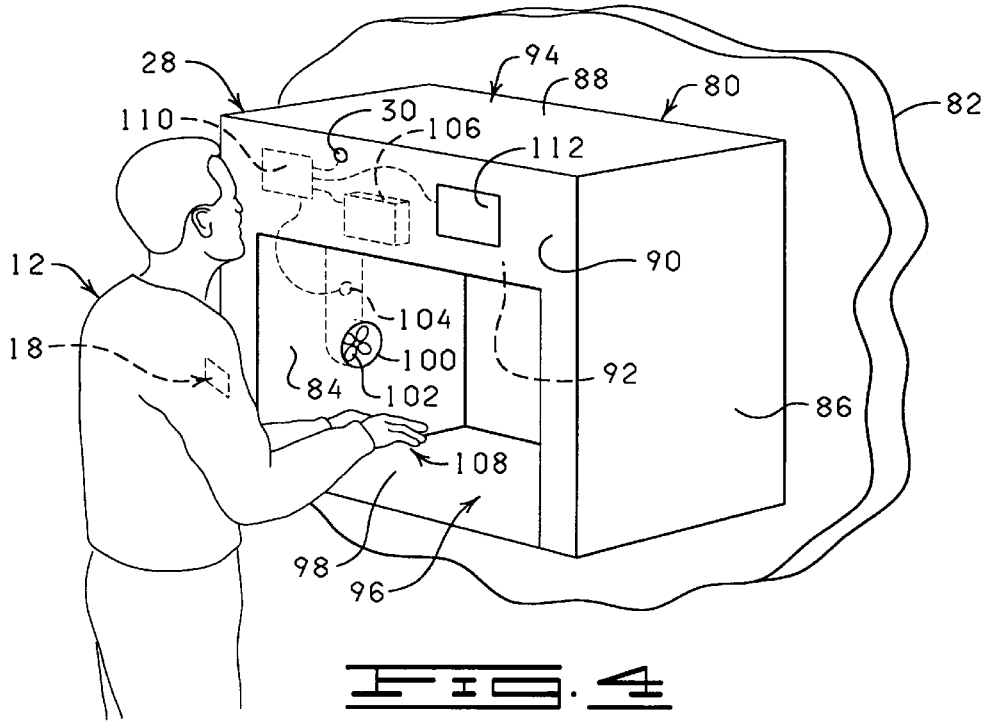
FIG. 4 is a perspective view of a worker wearing a badge element and the worker having his or her hands disposed in a compartment of a hygiene enforcing apparatus to determine if the worker has recently washed his or her hands with soap and water.
Figure 5:
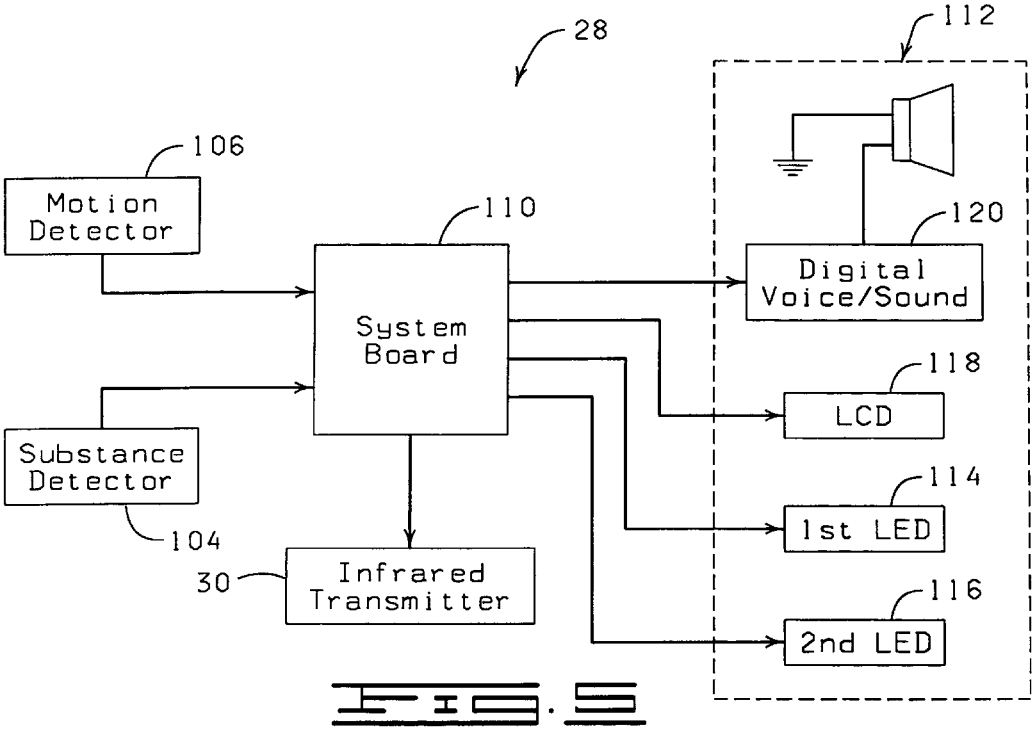
FIG. 5 is a block diagram of the electrical/electronic components of the hygiene enforcing apparatus.

The hygiene enforcing apparatus 28 is shown in more detail in FIG. 4 and a high level block diagram of the hygiene enforcing apparatus 28 is shown in FIG. 5. The size of the hygiene enforcing apparatus 28 has been exaggerated for purposes of clarity. The hygiene enforcing apparatus 28 is provided with a housing 80 typically supported by a supporting structure 82, such as a wall and the housing 80 is separate from a hand drying apparatus (not shown). The housing 80 is provided with a first side wall 84, a second side wall 86, a top wall 88, a front wall 90 and a medial wall 92 cooperatively positioned and connected substantially shown in FIG. 4. The top wall 88, front wall 90, medial wall 92, first side wall 84 and the second side wall 86 cooperate to provide the housing 80 with a first compartment 94 and a second compartment 96 substantially as shown in FIG. 4.

The first compartment 94 is generally closed, although access may be gained by placing hinges on the top wall 88, for example. The second compartment 96 is provided with a first opening 98 formed therethrough so that the worker 12 can dispose his or her hands through the first opening 98 and into the second compartment 96.

A second opening 100 is formed in the first side wall 84 such that the second opening 100 communicates with the second compartment 96. A fan 102 is disposed in the second opening 100 and operated to draw air from the second compartment 96 through the second opening 100. A substance detector 104 is disposed in the second opening 100 such that air drawn into the second opening 100 by the fan 102 is blown continuously across the substance detector 104. The substance detector 104 is indicated in FIG. 4 by the dashed lines. In one embodiment, the detectable substance in the soap can be a gas emitting substance such as alcohol. When the gas emitting substance in the soap is alcohol, the substance detector 104 can be a model 12 LG manufactured by the Davis Instrument Manufacturing Company, Seton Business Center, 4701 Mount Hope Drive, Baltimore, Md. 21215. It should be noted that the temperature of the alcohol detector is elevated an effective amount to vaporize gases during use. When the substance detector 104 is an alcohol detector, it may be necessary to operate the fan 102 continuously to blow air across the substance detector 104 to stabilize the temperature of the substance detector 104 and to thereby obtain an accurate reading therefrom.

A motion detector 106 is disposed on the medial wall 92 to detect the entrance of the hands 108 of the worker 12 into the second compartment 96 through the first opening 98. A system board 110 is disposed in the first compartment 94, and a communication media 112 is disposed on the front wall 90 and electrically connected to the system board 110. The system board 110 can include an embedded microcontroller. The communication media 112 can be configured with a first light 114, a second light 116, a display 118, a speaker system 120 and combinations thereof to provide visual and audible output to the worker 12. This makes it possible for the worker 12 to readily determine the mode of operation of the badge element 18 without having to look directly at the badge element 18 while the hygiene enforcing apparatus 28 checks the hands of the worker 12.

The second transmitter 30 is provided on the housing 80 of the hygiene enforcing apparatus 28 to be in the line of sight of the receiver 22 of the badge element 18 when the hands of the worker 12 are disposed in the second compartment 96.

In use, the worker 12 extends his or her hands into the second compartment 96 through the first opening 98 after such hands have been previously dried. The hands of the worker 12 may have been dried by paper towels, or a hot air blower, for example. By analyzing the hands of the worker 12 when such hands are dry, this eliminates the problem of the hands dripping water onto the floor of the sanitation area 16 while such hands 108 are being analyzed.

Upon entry of the hands into the second compartment 96, the motion detector 106 sends a signal to the system board 110 to begin analyzing input received from the substance detector 104. If the concentration of the substance detected by the substance detector 104 is within a preselected range, the system board 110 enables the second transmitter 30 to transmit a signal to the receiver 22 of the badge element 18 to enable the sanitary signaling media and to disable the unsanitary signaling media of the communication media 20. The system board 110 also transmits a signal to the communication media 112 to enable a sanitary signaling media to indicate to the worker 12 that he or she has satisfactorily washed his or her hands with soap and water. The worker 12 now has about 15 seconds to exit the sanitation area 16 as previously discussed with reference to FIGS. 2 and 3.

If the concentration of the detectable substance detected by the substance detector 104 is below the predetermined range, the system board 110 does not send a signal to the second transmitter 30, or the communication media 112. Thus, the communication medias 20 and 112 on the badge element 18 and the hygiene enforcing apparatus 28, respectively, remain transmitting the unsanitary signaling media.

If the concentration of the detectable substance detected by the substance detector 104 is above the predetermined range, then, the system board 110 outputs a signal to the second transmitter 30, and the communication media 112 to enable the tamper signaling media on the communication medias 20 and 112 of the badge element 18 and the hygiene enforcing apparatus 28, respectively. It should be noted that the tamper signaling media on the communication media 112 of the hygiene enforcing apparatus 28 is automatically disabled and the unsanitary signaling media is automatically enabled after the passage of a predetermined period of time subsequent to the enabling of the tamper signaling media.

When the substance detector 104 is an alcohol detector as previously discussed, the predetermined range may be between about 50 to about 1,000 parts per million. Thus, the worker 12 will have difficulty circumventing the required hygienic procedures, as, for example, by not using soap during the hand washing procedure or by using too much soap and/or not enough water. In other words, if the worker 12 using the facilities does not perform the hand washing operation in a predetermined acceptable manner, the unsanitary signaling media will not be disabled when the worker's hands are being analyzed and the system 10 will continue to output the unsanitary signaling media.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A system for encouraging workers who work in a hygienically controlled area to wash their hands before exiting an associated sanitation area, comprising:

a badge element for each worker;

an unsanitary signaling media on each badge element;

means for attaching the badge element to the worker; and means for enabling the unsanitary signaling media in response to the attaching of the badge element to the worker.

2. A system as recited in claim 1, further comprising:

a sanitary signaling media on each badge element; and means for enabling the sanitary signaling media to indicate that the worker has likely washed his or her hands with soap and water.

3. A system as defined in claim 2, wherein the means for enabling the sanitary signaling media includes:

a soap mixture in the sanitation area containing a detectable substance; and detector means located in the sanitation area for enabling the sanitary signaling media responsive to the detection of a concentration of the detectable substance within a preselected range.

4. A system as defined in claim 3, further comprising:

a tamper signaling media on each badge element; and wherein the detector means includes means for enabling the tamper signaling media responsive to the detection of a concentration of the detectable substance above the preselected range.

5. A system as recited in claim 1, wherein the means for attaching the badge element includes:

a clip switch attached to the badge element for attaching the badge element to the worker;

and wherein the means for enabling includes:

means for sensing the attaching of the clip switch to the worker for activating the badge element.

6. A system as recited in claim 1, further comprising:

a first transmitter positioned in the sanitation area, the first transmitter transmitting a signal;

a compatible receiver on each badge element to receive the signal from the first transmitter when the worker wearing the badge element enters the sanitation area;

means for enabling the unsanitary signaling media on the badge element in response to the receiver receiving the signal from the first transmitter;

means for disabling the unsanitary signaling media to indicate that said worker has likely washed his or her hands with soap and water; and means for disabling the reception of the signal by the receiver for the passage of a predetermined time period subsequent to the unsanitary signaling media being disabled whereby the worker who likely washed his or her hands can exit the sanitation area in the predetermined period without the unsanitary signaling media being reenabled.

7. A system as defined in claim 1, further comprising:

a tamper signaling media on each badge element;

a light sensitive receiver on each badge element and positioned to receive light when the worker is wearing the badge element; and means for enabling the tamper signaling media in response to the absence of the light sensitive receiver receiving light for the passage of a predetermined period of time.

8. A system for encouraging workers who work in a hygienically controlled area to wash their hands before exiting an associated sanitation area, comprising:

a soap containing a detectable substance, for being disposed on the worker's hands when the worker washes their hands;

detection means for detecting the presence of the detectable substance on the hands of the worker; and communication means operatively associated with the detection means for communicating an unsanitary signaling media responsive to the detection of the presence of the detectable substance on the hands of the worker below a preselected range.

9. A system as recited in claim 8, wherein the detection means includes a housing separate from a hand dryer, and wherein the housing of the detection means defines a compartment sized to receive the hands of the worker and the detection means further includes:

a substance detector; and means for moving air from the compartment to the substance detector.

10. A system as recited in claim 8, wherein the communication means further comprises means for communicating a tamper signaling media responsive to the detection of the presence of the detectable substance on the hands of the worker above the preselected range.

11. A system as recited in claim 8, wherein the detector means includes:

a housing supported by a supporting structure, the housing comprising:

a first compartment; and a second compartment sized to receive the hands of the worker, the second compartment defining a first opening to permit workers to dispose their hands through the first opening and into the second compartment;

an unsanitary signaling media on the housing;

a sanitary signaling media on the housing;

a tamper signaling media on the housing;

a substance detector disposed on the housing and being capable of outputting a signal indicative of the concentration of the detectable substance detected on the hands of the worker;

means on the housing for moving air from the second compartment to the substance detector; and system board means disposed in the first compartment for receiving the signal output by the substance detector, and for enabling the unsanitary signaling media responsive to the concentration of the detectable substance being below a predetermined range, and for enabling the sanitary signaling media responsive to the concentration of the detectable substance being within the predetermined range, and for enabling the tamper signaling media responsive to the concentration of the detectable substance being above the predetermined range.

12. A system for encouraging workers who work in a hygienically controlled area to wash their hands before exiting an associated sanitation area, comprising:

means located in the sanitation area for receiving at least a portion of the hands of the worker;

detector means, operatively associated with the means for receiving, for detecting whether or not the hands of the worker have recently been washed subsequent to the insertion of the hands of the worker into the means for receiving; and means operatively associated with the detector means for outputting one of a sanitary signaling media in response to the detection that the hands of the worker have been washed and an unsanitary signaling media in response to the detection that the hands of the worker have not been washed.

13. A system as recited in claim 12, further comprising:

a badge element for each worker;

an unsanitary signaling media on each badge element;

means for attaching the badge element to the worker; and means for enabling the unsanitary signaling media in response to the attaching of the badge element to the worker.

14. A system as recited in claim 13, wherein the means for attaching the badge element comprises:

a clip switch attached to the badge element for attaching the badge element to the worker; and wherein the means for enabling comprises:

means for sensing the attaching of the clip switch to the worker for activating the badge element.

15. A system as recited in claim 12, further comprising:

a badge element for each worker;

a first transmitter positioned in the sanitation area, the first transmitter transmitting a signal;

a compatible receiver on each badge element to receive the signal from the first transmitter when the worker wearing the badge element enters the sanitation area;

means for enabling the unsanitary signaling media on the badge element in response to the receiver receiving the signal from the first transmitter;

means for disabling the unsanitary signaling media to indicate that said worker has likely washed his or her hands with soap and water; and timer means for disabling the reception of the signal by the receiver for the passage of a predetermined time period subsequent to the unsanitary signaling media being disabled whereby the worker who likely washed his or her hands can exit the sanitation area in the predetermined period without the unsanitary signaling media being reenabled.

16. A system as defined in claim 12, further comprising:

a badge element for each worker;

a tamper signaling media on each badge element;

a light sensitive receiver on each badge element and positioned to receive light when the worker is wearing the badge element; and means for enabling the tamper signaling media in response to the absence of the light sensitive receiver receiving light for the passage of a predetermined period of time.

17. A system as defined in claim 12, further comprising:

a soap mixture in the sanitation area having a diluted concentration of a detectable substance therein; and wherein the detector means enables the sanitary signaling media responsive to the detection of a concentration of the detectable substance within a preselected range.

18. A system as defined in claim 17, wherein the detector means further comprises:

means for outputting a tamper signaling media responsive to the detection of a concentration of the detectable substance above the preselected range.

* * * * *